United States Patent [19]

Anderson

[11] Patent Number: 4,936,716

[45] Date of Patent: Jun. 26, 1990

[54] TRANSPORT DEVICE FOR PNEUMATICALLY TRANSPORTING PARTICULATE MATERIAL FROM A CONTAINER UNDER HIGH PRESSURE TO A CONTAINER UNDER LOW PRESSURE

[75] Inventor: Jim S. Anderson, Finspong, Sweden

[73] Assignee: Abb Stal AB, Finspong, Sweden

[21] Appl. No.: 382,020

[22] Filed: Jul. 18, 1989

Related U.S. Application Data

[63] Continuation of Ser. No. 124,146, Nov. 23, 1987, abandoned.

[30] Foreign Application Priority Data

Dec. 3, 1986 [SE] Sweden ..... 8605199

[51] Int. Cl.[5] ..... B65G 53/58

[52] U.S. Cl. ..... 406/168; 406/83; 138/42

[58] Field of Search ..... 165/44, 120; 138/40, 138/42, 43; 406/168, 83, 154, 191, 193, 194, 195, 182

[56] References Cited

U.S. PATENT DOCUMENTS

| | | | |
|---|---|---|---|
| 1,883,656 | 10/1932 | Estock | 138/42 |
| 1,915,867 | 6/1933 | Penick | 138/42 |
| 1,942,598 | 1/1934 | Hewgley | 138/42 |

FOREIGN PATENT DOCUMENTS

| | | | |
|---|---|---|---|
| 100752 | 1/1898 | Fed. Rep. of Germany | 138/42 |

*Primary Examiner*—Joseph F. Peters, Jr.

*Attorney, Agent, or Firm*—Pollock, Vande Sande & Priddy

[57] ABSTRACT

A transport device for pneumatically transporting particulate material from a container which is under pressure to a container which is under a lower pressure, in which successive pressure reduction is achieved by repeated deceleration and acceleration of the particulate material in the gas-particle flow and by diversion of the gas-particle flow. The transport device includes a number of rectilinearly arranged nozzles and cup-shaped containers placed downstream of the nozzles and alternating with the nozzles. The cup-shaped containers receive material flowing out of the nozzles. The containers are arranged such that a channel is formed around the outside walls of the containers through which the particulate material flows to a downstream nozzle.

6 Claims, 2 Drawing Sheets

1
2
3
4
5
6
7
8
10
12
13
14
15
16
17
20
21
22
27
28
30
31
32
G
G

A-A

TRANSPORT DEVICE FOR PNEUMATICALLY TRANSPORTING PARTICULATE MATERIAL FROM A CONTAINER UNDER HIGH PRESSURE TO A CONTAINER UNDER LOW PRESSURE

This application is a continuation of Ser. No. 124,146, filed on Nov. 23, 1987 abandoned.

TECHNICAL FIELD

The present invention relates to a transport device for pneumatically transporting particulate from a container which is under pressure to a receiving container which is under a lower pressure. The transport device also forms a pressure reducing device and a gas flow limiter. The device includes a number of units having such dimensions that, for a particular material flow and pressure difference, a flow of transport gas suitable for the material transport is obtained. The invention is primarily intended for the continuous removal of formed ashes and consumed sulphur absorbent which are separated from the combustion gases in a power plant with combustion of a fuel in a pressurized fluidized bed, a so-called PFBC plant ("PFBC" being the initial letters in the expression Pressurized Fluidized Bed Combustion). However, it is applicable for other purposes as well, for example for the removal of bed material from a bed vessel in a PFBC power plant, or of material from units in a coal gasification plant.

BACKGROUND ART AND OBJECT OF THE INVENTION

The invention is an improvement of the transport device described in European Patent No. 0 108 505.

The object of the present invention is to provide a pressure reducing pneumatic transport device for the removal of particulate material from a pressurized container to a container which is under a lower pressure, which device is compact, requires little space, is easily replaceable, and can be used for continuous removal of material thus replacing complicated lock hopper systems.

THE INVENTION

According to the invention, the transport device includes a number of rectilinearly arranged nozzles as well as cup-shaped containers which are arranged in a channel on the downstream side of the nozzles opposite to the nozzle opening, the cup-shaped containers receiving particulate material flowing out of the nozzles and forming together with the channel wall an annular gap. The cup-shaped container is made with such a depth that an erosion preventing material cushion is formed at the bottom thereof. In one embodiment there is an annular space around the nozzles, which is open at the upstream end of the nozzle and sealed by a bottom at the downstream end of the nozzle. This bottom joins the nozzle to a surrounding sleeve.

The nozzle or the nozzle with the above-mentioned sleeve can be constructed as one unit and the cup-shaped container and the surrounding sleeve as another unit. These units can be placed, in a suitable number, one after the other in a tube. Alternatively, the nozzle and the cup-shaped container can be arranged in a common sleeve and form one unit. Such units are placed in a row one after the other in a tube.

The advantages derived from the invention are that the pressure reducing part of the transport device can be constructed from few, similar components and that the transport device will be very compact. Since the components included can be arranged one after the other in a tube, the number of series-connected units arranged in series can be easily varied and the transport device can be easily adapted in dependence on the pressure difference between the containers and the amount of material that is to be transported. Because the units included are placed in a tube, they need not be welded together, which reduces the number of weld joints for the construction of the transport device.

BRIEF DESCRIPTION OF THE DRAWING

The invention will be described in greater detail with reference to the accompanying schematic drawing, wherein.

DESCRIPTION OF THE PREFERRED EMBODIMENT

Figure 1:
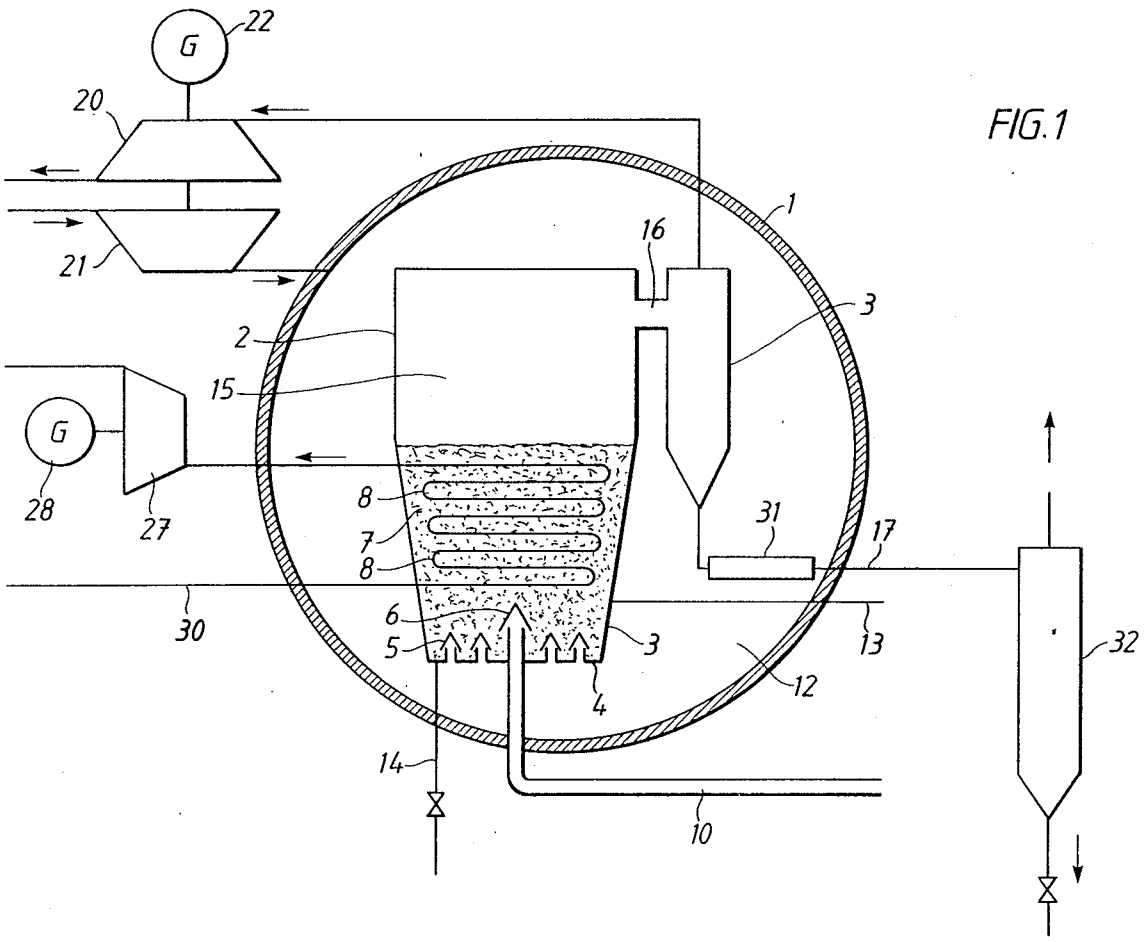
FIG. 1 shows the invention as applied to a PFBC power plant for the removal of dust from a gas cleaner to a container under atmospheric pressure.

In the drawing numeral 1 designates a pressure vessel. In the present vessel (11) there are arranged a bed vessel or combustion chamber 2 and a gas cleaning plant symbolized by a cyclone 3. The bed vessel 2 is provided with a bottom 4 with air nozzles 5 and fuel nozzles 6. The bed vessel 2 contains a bed 7 of a particulate bed material containing or completely consisting of a sulphur absorbent such as lime or dolomite. The lower part of the bed vessel 2 contains tubes 8 for cooling the bed 7 and for generating steam. Fuel is supplied to the bed 7 via the conduit 10 and nozzles 6. Air for combustion of this fuel and for fluidization of the material in the bed 7 is supplied to the bed vessel 2 from the space 12 between the pressure vessel 1 and the bed vessel 2 through the nozzles 5 of the bottom 4. Bed material is supplied to the bed 7 through a conduit 13 and is removed through a conduit 14.

Combustion gases are collected in the freeboard 15 above the bed 7 and are passed through the conduit 16 to the cyclone 3, in which dust is separated and removed through the conduit 17. Through a conduit the gases are passed to the turbine 20 which drives a compressor 21 which compresses combustion air supplied to the space 12. The turbine 20 also drives a generator 22. The gases leaving the turbine 20 are passed through a conduit to a feed water preheater and from there through a conduit to a chimney.

Steam generated in the tubes 8 is passed to the steam turbine 27, which drives the generator 28. Consumed steam is passed to the condenser and from there to the feed water tank. By means of a feed water pump, condensate is returned to the tubes 8 of the bed vessel 2 through the conduit 30.

In the ash discharge conduit 17 there is a pressure reducing device 31, which is so dimensioned that a gas flow, necessary for the removal of separated dust, is obtained at the pressure difference prevailing between the gas cleaner and a receiving container 32, in which the pressure is approximately equal to the atmospheric pressure.

Figure 2:
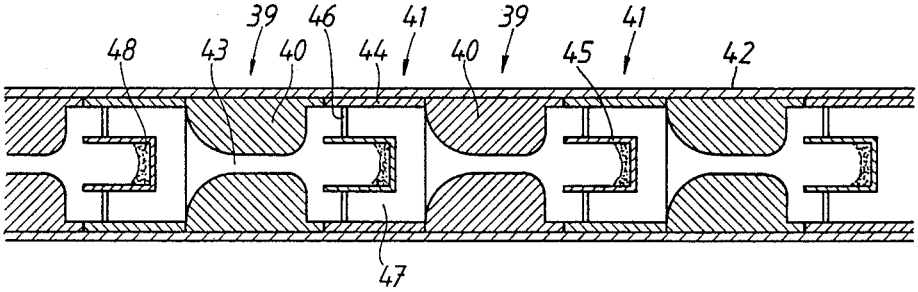
FIG. 2 shows an axial section of the prssure reducing part of the transport device according to the present invention in the conveying pipe.

As shown in FIG. 2, the pressure reducing device 31 may be constructed from a number of standardized units 39 and 41, which ae placed in series one after the other in a sleeve or a tube 42. The unit 39 forms a nozzle 40 with a channel 43. The unit 41 consists of a sleeve 44, a cup-shaped container 45 and a spider 46 which joins the container 45 to the sleeve 44. Between the container 45 and the sleeve 44 a substantially annular gap 47 is formed. The container 45 is orientated with its opening opposite to and facing the downstream opening of the nozzle channel 43. The container 45 thus receives the flow of particulate material which leaves the nozzle unit 40. This material is decelerated in the container 45 to a low velocity, after which the material changes direction, flows over the edge of the container 45 and is accelerated, thus obtaining a pressure-reducing energy loss. The material continues to flow to the channel 43 in the subsequent unit 39, through the axial flow channel 47 formed between the container 45 and the surrounding sleeve 44. The container 45 has such a depth as to form an erosion preventing material cushion 48 at the bottom thereof.

Figure 3:
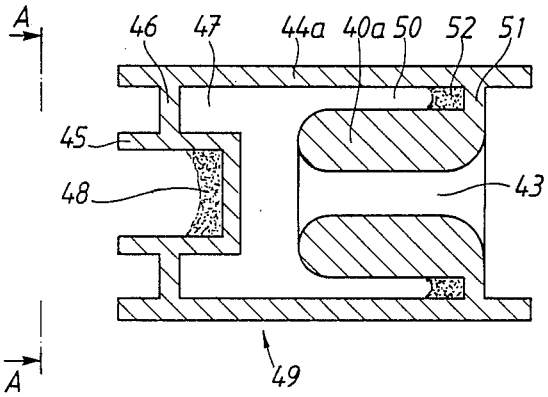
FIG. 3 shows an axial section of an alternative embodiment of a unit included in the transport device.
Figure 4:
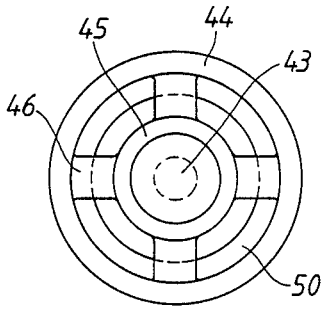
FIG. 4 shows an end view of the unit according to FIG. 3.

In the embodiment according to FIG. 3, the units 39 and 41 are built together to form one unit 49, the cup-shaped container 45 and the nozzle 40 being placed in a common sleeve **44*a*. The outer diameter of the nozzle 40*a* is smaller that the inner diameter of the sleeve 44*a*, thus forming an annular space 50 between the nozzle 40 and the sleeve 44*a*. This space 50 is open at the upstream end of the nozzle 40*a* and sealed at the downstream part of the nozzle 40*a* by a bottom 51 which joins the nozzle 40 to the sleeve 44*a*. The space 50 has such a depth as to form an erosion preventing material cushion 52 at the bottom 51. Material flowing through the gap 47 flows down into the space 50, is decelerated and accelerated and continues through the nozzle 40*a*** to the next unit.

I claim:

1. A transport device for pneumatically transporting a particulate material from a container which is under pressure to a container which is under a lower pressure through a conveying pipe in which a successive pressure reduction is achieved by the loss of energy due to repeated deceleration and subsequent acceleration of the particulate material in gas-particle flow and diversion of the gas-particle flow, said device comprising:

a plurality of rectilinearly arranged nozzles and a cup-shaped container located downstream of each of said nozzles with an opening of said container being substantially aligned with an outlet of said nozzle, said cup-shaped container receiving and decelerating said particulate material flowing out of said nozzle outlet, and a channel through which said material flows from said cup-shaped container to a subsequent nozzle, said channel being formed around said cup-shaped container between an outer wall of said container and a wall of a surrounding tube; and wherein said container has a preselected depth which causes formation of an erosion-preventing cushion containing particulate material at the bottom thereof, thereby reducing wear of said transport device.

2. A transport device according to claim 1, wherein a substantially annular space is provided around said nozzle, said annular space being open at an upstream end of said nozzle.

3. A transport device according to claim 2, wherein said annular space has a preselected depth which causes formation of an erosion preventing cushion including the particulate material at a bottom of said annular space.

4. A transport device according to claim 2, wherein a plurality of separate units containing a nozzle and units containing a cup-shaped container are arranged in said surrounding tube.

5. A transport device according to claim 3, wherein a plurality of separate units containing a nozzle and units containing a cup-shaped container are arranged in said surrounding tube.

6. A transport device according to claim 1, wherein a nozzle and a cup-shaped container are a single member, with a plurality of said members arranged successively in said surrounding tube.

* * * * *